United States Patent [19]

Pytlewski et al.

[11] 4,430,208

[45] Feb. 7, 1984

[54] METHOD FOR THE SOLVENT EXTRACTION OF POLYCHLORINATED BIPHENYLS

[75] Inventors: Louis J. Pytlewski; Edward J. Thorne, both of Philadelphia, Pa.

[73] Assignee: The Franklin Institute, Philadelphia, Pa.

[21] Appl. No.: 440,232

[22] PCT Filed: Jun. 2, 1982

[86] PCT No.: PCT/US82/00749

§ 371 Date: Oct. 29, 1982

§ 102(e) Date: Oct. 29, 1982

[51] Int. Cl.[3] ..... C10G 17/00

[52] U.S. Cl. ..... 208/262; 210/909; 585/469

[58] Field of Search ..... 208/262; 570/204; 585/469; 210/634, 635, 757, 758, 909

[56] References Cited

U.S. PATENT DOCUMENTS

| | | | |
|---|---|---|---|
| 4,284,516 | 9/1981 | Parker et al. | 210/757 |
| 4,326,090 | 4/1982 | Smith et al. | 585/469 |
| 4,337,368 | 6/1982 | Pytlewski et al. | 568/730 |
| 4,351,718 | 9/1982 | Brunelle | 208/262 |
| 4,353,793 | 10/1982 | Brunelle | 208/262 |

OTHER PUBLICATIONS

Nepier et al., "Evaluation and Development of Polychlorinated Biphenyl Removal Processes", Published Feb. 5, 1982 by Union Carbide Corp.

*Primary Examiner*—Curtis R. Davis

*Attorney, Agent, or Firm*—Dann, Dorfman, Herrell and Skillman

[57] ABSTRACT

A process for the removal and detoxification of polychlorinated biphenyls (PCBs) present in dielectric or other fluids, such as transformer oil, employing polyethylene glycol as the primary extractant, cyclohexane as a secondary extractant and a reagent derived from the reaction of sodium or sodium hydroxide, polyethylene glycol and oxygen for the decomposition and detoxification of the PCBs.

33 Claims, 1 Drawing Figure

METHOD FOR THE SOLVENT EXTRACTION OF POLYCHLORINATED BIPHENYLS

BACKGROUND OF THE INVENTION

The commercial introduction of polychlorinated biphenyls (PCBs) in 1929 represented a major breakthrough in the technology of dielectric fluids. These compounds were found to have outstanding thermal stability, resistance to oxidation, acids, bases and other chemical agents, as well as excellent electrical insulating characteristics making them ideal for applications in electrical capacitors and in high performance electrical transformers. PCBs gained rapid and widespread acceptance in the electrical industry.

In 1966, the discovery of PCBs in environmental samples stimulated concern over, and considerable research on their potential toxic hazards. By the early 1970's those hazards had become well recognized, and prompted major manufacturers of PCBs to restrict sales to applications in closed electrical systems. All production of PCBs was stopped in 1977.

During the 1970's the U.S. Environmental Protection Agency (EPA) set out to develop guidelines for control of PCBs. This effort culminated in publication of a series of regulations on PCBs handling and disposal requirements in the *Federal Register* on May 31, 1979 and Mar. 28, 1980. See also: "EPA's Final PCB Ban Rule: Over 100 Questions and Answers to Help You Meet These Requirements", Office of Toxic Substances, EPA, Washington, D.C. (June 1980). These regulations cover the maintenance, operation, and disposal of three classes of transformers, as follows:

Below 50 ppm—Noncontaminated [Non-PCB Transformer]

50 ppm to 500 ppm—PCB Contaminated Transformer

Above 500 ppm—PCB Transformer;

the higher the concentration of PCBs in the transformer, the stricter the regulations.

These regulations have had particular impact on electrical utility companies. Although PCBs have not been used extensively in general purpose distribution transformers, cross contamination in transformer manufacturing and service facilities over many years has resulted in widespread appearance of relatively small amounts of PCBs in many transformers.

The development of acceptable procedures for operating under the EPA regulations has become the subject of intensive research. The principal effort has been directed toward development of safe and effective PCB disposal techniques. Until recently the only accepted methods of disposal were by dumping in rigidly designed safe land fills or burning in carefully controlled high temperature incinerators. However, lack of approved facilities has limited disposal capacity by these methods. Such methods are also wasteful and reslt in permanent decommissioning of transformers or destruction of valuable and relatively scarce dielectric fluids.

Because of their remarkable stability PCBs are not only resistant to biological degradation but also to most of the well-known chemical decomposition methods. Some chemical decontamination methods which have reportedly produced positive results suffer from one or more serious limitations. The most widely reported chemical methods for decomposing PCBs employ extremely reactive sodium compounds. Sodium in liquid ammonia has long been used for this purpose in analytical chemical laboratories. Other decomposition processes for PCBs which are claimed to be effective employ high surface sodium, sodium/naphthalene, and sodium naphathalide. These processes share some notable drawbacks. The reagents are difficult to prepare, expensive to ship and unstable in storage. Moreover, active sodium compounds are sensitive to oxygen and to water and therefore cannot be used reliably under field conditions.

A few combined chemical/physical methods of PCB disposal have also been reported. See: O. Hutzinger, et al., "The Chemistry of PCBs", CRC Press Cleveland, Ohio, (1974). For example, radiation can destroy PCBs under certain conditions, but the process is slow, inefficient and not readily adaptable to field use. Some polymers, such as chloroprene derivatives, have been used to absorb PCBs from oil but these also apparently have limited effectiveness because of very low absorption capacity and very slow absorption rate.

During the past several years the Franklin Research Center of the Franklin Institute, Philadelphia, Pa. has developed a proprietary system for stripping the chlorine substituents from PCBs, thus rendering them nontoxic and readily disposable. More specifically, Pytlewski, Krevitz and Smith, in their U.S. patent application Ser. Nos. 142,865 and 158,359, filed Apr. 21, 1980 and June 11, 1980, respectively, disclose and claim a method for the decomposition of halogenated organic compounds, especially PCBs, which represents a significant advance over the aforementioned methods of the prior art. The decomposition reagent used in practicing that method is produced by reacting an alkali metal, a liquid reactant, such as a polyglycol or a polyglycol monalkyl ether, and oxygen. This reagent produces virtually complete dehalogenation of a variety of halogenated organic compounds, simply by mixing it with the halogenated compound in the presence of oxygen. Additional details of the methods of preparation and use of the previously discovered decomposition reagent are set forth in the two applications identified above, the entire disclosures of which are incorporated herein by reference as though set forth herein in full.

In U.S. patent application Ser. No. 240,622, filed Mar. 5, 1981, the entire disclosure of which is also incorporated herein by reference as though set forth herein in full, there is described and claimed another invention by the same inventors based on the discovery that decomposition of halogenated organic compounds may be carried out using a reagent produced by the reaction of an alkali metal hydroxide (rather than an alkali metal), a liquid reactant, such as a polyglycol or a polyglycol monalkyl ether, and oxygen. This decomposition reagent gives results which are comparable to those obtained with the method described in the earlier filed applications referred to above.

The reagents of the aforesaid copending applications are collectively referred to hereinafter as NaPEG reagents, or simply NaPEG.

The development of the NaPEG reagents has made it possible to remove PCBs from fluids contaminated therewith, as well as to decompose PCBs in a safe, efficient and effective manner.

SUMMARY OF THE INVENTION

In accordance with the present invention, there is provided a process for reducing the level of PCBs in a dielectric fluid by extracting with one or more polyethylene glycols (PEG). By so doing the PCB level of the fluid may be reduced to to below 50 ppm. The process may be used to advantage in converting PCB Contaminated Transformers to Noncontaminated Transformers.

No specially designed equipment is required for the practice of this invention. The estimated cost of installation, operation, and maintenance of the process is less than the cost of replacement of the dielectric fluid. Reduction of PCBs to an acceptable level may be accomplished in about one to two weeks, and the treated oil meets current ASTM standards.

The present process is applicable to transformer sizes above 500 KVA through the largest EHV power transformer, and to loaded and energized transformers having oil temperatures between about 40° C. and 95° C.

Other advantages of the process are that the chemical agents used are compatible with transformer materials, and that the toxic materials isolated in the course of carrying out the process, upon further treatment, may be rendered non-toxic, allowing for easy disposal thereof. The hazard potential in carrying out the process is quite small since there is minimal contact with contaminated oil or vapor during installation and operation.

The present invention satisfies the criteria set forth in the recent publication of the Electrical Power Research Institute (EPRI), RFR 5592, Aug. 22, 1980, and thus constitutes an appropriate procedure for reducing PCBs in field-installed transformers to the Noncontaminated level under the EPA regulations.

In accordance with one aspect of the present invention, there is carried out a continuous, multi-stage extraction of PCB's from fluids contaminated therewith using polyethylene glycols (PEG), which have been determined to have a selective attraction for PCBs. The process of the present invention is universally applicable to all known PCBs and PCB-containing oils, including, but not limited to, the widely used Inerteen- and Pyranol-types. This process has the advantage over the acetonitrile extraction process recommended by the Environmental Protection Agency that it does not extract the aliphatic hydrocarbon components of the transformer fluids or other contaminated fluid, which complicates the analysis of acetonitrile-extracted PCB components.

The polyethylene glycol extraction of PCBs from transformer fluids or other liquids according to this invention is preferably followed by a second extraction of the PCBs from the PEG solution with cyclohexane or a similar non-polar solvent. The concentrated and isolated PCBs thus obtained may then be decomposed by techniques known to the art to remove the chlorine substituents from the PCBs, rendering them non-toxic and readily disposable.

The present invention also provides a means for rapidly and easily determining the concentration of PCBs in a given sample of dielectric or other fluid. This is accomplished by first extracting the PCBs from the transformer fluid with polyethylene glycol, subsequently extracting the PCBs from the polyethylene glycol solution by cyclohexane extraction, as described above, and thereafter analyzing the PCB-cyclohexane extract by gas chromatography-electron capture (g.c.-e.c.) to determine its PCB concentration.

The extraction process of the present invention is an improvement over previous technology in that interference due to water present in the system is largely eliminated. Indeed, the polyethylene glycol extraction agent may contain up to 15% water by weight and still cause no interference with the present process, since such an amount of water is readily dissolved in the polyethylene glycol without retaining appreciable amounts of PCBs, and can be discarded therewith or removed, if desired. In general, the possibilty of water interfering with the present invention when used to treat PCB-contaminated hydrocarbon oils may be readily avoided. Water will form a two phase system with hydrocarbon oils and may be decanted therefrom, and high grade extraction agents containing less than 2% water are commercially available.

The present invention is based upon the unexpected discovery that polyethylene glycols, even though immiscible with transformer oils or other non-polar dielectric fluids, are capable of selectively dissolving PCBs in such fluids and removing them without altering the essential composition of the oil. Polyethylene glycols having a wide range of molecular weights, i.e., both liquids and solids, are effective for this purpose. For example, liquid polyethylene glycol having an average molecular weight of about 400 has been found to be very effective in extracting PCBs from transformer oil. Lower molecular weight polyethylene glycol is also effective. On the other hand, solid polyethylene glycol, such as Carbowax®, having an average molecular weight of about 20,000 is also very effective in extracting PCB's from transformer oil, as are solid polyethylene glycols of even higher molecular weight.

It has been found, moreover, that polyethylene glycol, whether liquid or solid, is able to selectively remove about 25 to 35% of the content of PCBs in a transformer oil in a single extraction and that the PCBs may be removed substantially completely in about 3 to 8 extractions, depening upon the particular PCB-type involved and certain other factors. Moreover, the presence of water in the oil to be treated does not appreciably interfere with the polyethylene glycol extraction, nor is there any significant contamination of the treated oil by the polyethylene glycol. It is preferred that about equal volumes of polyethylene glycol and oil be employed in order to achieve the most efficient extraction, although higher proportions of polyethylene glycol up to about 3:1, or lower proportions of as little as 1:3 may be employed with success. The number of extractions necessary will depend on the PCB level in the oil to be treated. To convert a transformer from the PCB Contaminated Transformer classification to the Noncontaminated classification, at 25% to 35% extraction efficiency with each extraction, will generally require from about 3 to about 8 extractions.

Having completed the primary extraction of PCBs from the transformer oil or other dielectric fluid, it is desirable to carry out a secondary extraction of PCBs from the PEG-PCB solution by the use of cyclohexane or a similar solvent. In this way the PCBs are removed from the polyethylene glycol which may then be recycled for a second primary extraction, and so on, until all PCBs are removed.

The present extraction process is fully operative at ambient temperatures or at the normal operating temperatures of electrical transformers in the range from about 40° to about 95° C. The process of the present invention can be conducted on an operating transformer without shut-down, for example, by treating fluid drawn from the transformer.

The cyclohexane-PCB extract may be processed further in various ways depending upon the desired result.

It may be analyzed for PCB content by conventional gas chromatography-electron capture detection techniques. Inasmuch as the cyclohexane extraction has been found to effect substantially quantitative removal of PCBs from the polyethylene glycol-PCB solution, the PCB content of the original transformer oil may thus be reliably determined.

The PCBs present in the cyclohexane solution may be rendered non-toxic by any suitable means known to the art. It is preferred in the process of the present invention to accomplish this by dehalogenating the PCB using NaPEG reagents, which, as previously mentioned, include a family of chemical derivatives of alkali metal (or alkali metal hydroxide) and liquid reactants, such as polyethylene glycol. These reagents are produced from relatively low cost raw materials without significant manufacturing problems; and they are stable in the presence of air and water, easily shipped and relatively safe. They present no flammability or dangerous decomposition hazards (over one year storage), but are highly basic (similar alkalinity of 0.1 N sodium hydroxide).

The dehalogenation properties of the NaPEG reagents are remarkable. They can be used to dehalogenate PCBs (and many other halogenated materials) in concentrated or dilute form. Dehalogenation of PCBs, for example, occurs in a few minutes at temperatures on the order of 100° C. using approximately stoichiometric quantities of reagent. Reaction also occurs, albeit more slowly, at ambient temperatures. Reaction products from dehalogenation include sodium chloride and various oxygenated aromatic compounds that are easily disposable under environmentally safe conditions.

Figure 1:
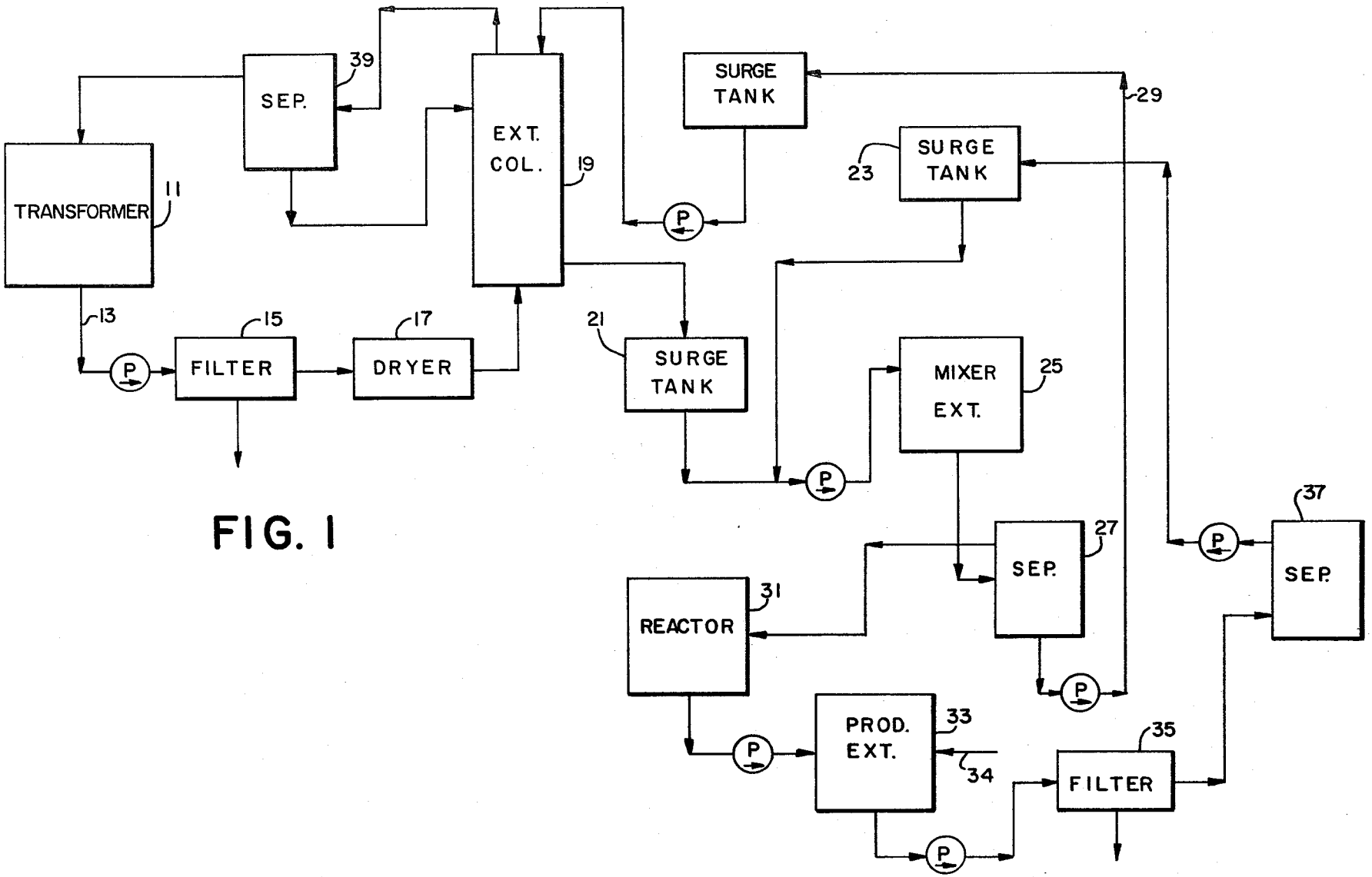
FIG. 1 is a flow diagram of a process for the extraction of PCBs from the oil of an operating electrical transformer.

As illustrated in the drawing, transformer oil is taken off from an operating transformer 11 as a stream (indicated by arrow 13) and passed by means of pump P through a filter 15 for removal of solids, then a dryer 17, and thereafter to an extraction column 19. Polyethylene glycol is fed from surge tank 20 to the extraction column counter-currently, and the resulting PCB-rich polyethylene glycol solution is drawn off at the bottom of the extraction column, and pumped from surge tank 21 together with cyclohexane from surge tank 23 into a mixer-extractor 25 from whence the mixture is delivered to separator 27 where the mixture separates into two liquids phases. From the separator, the lower phase consisting essentially of polyethylene glycol freed from PCBs and cyclohexane is recycled through surge tank 20 to extraction column 19 (as indicated by arrow 29). The upper phase from separator 27, consisting essentially of a cyclohexane-PCB solution, is heated to evaporate cyclohexane, which is recycled to surge tank 23 for further use, and the remaining product, consisting essentially of PCBs, is transferred to reactor 31 containing a NaPEG reagent (from a source not shown), and the chlorine substituents are stripped from the PCBs. The resulting decomposition mixture, containing sodium chloride and various oxygenated derivatives of the PCBs, are discarded.

Polyethylene glycol and cyclohexane needed initially or as make-up may be added to surge tank 20 and to surge tank 23, respectively.

Transformer oil mixed with some polyethylene glycol is drawn off at the top of extraction column 19 and sent to a separator 39 where the polyethylene glycol is separated and recycled to the extraction column. The product from separator 39, which is transformer oil containing no more than 50 ppm PCB is returned to the transformer. In this way the PCB content of the transformer oil can be reduced to, and maintained at the desired acceptable concentration.

All of the equipment utilized in the above-described process is conventional and commercially available and requires no modification or special design or construction. The unit operations are all standard and well known. The system as a whole is connected to the transformer through conventional valving and conduits.

The secondary extraction of PCBs with cyclohexane permits recycling of the primary extractant with minimal processing and expense.

The detoxification of the PCB content of the secondary extract by the use of the NaPEG reagents according to the process of the U.S. patent application Ser. Nos. 142,865, 158,359 and 240,662, referred to above completes an efficient and low cost system of ridding contaminated fluids of toxic PCBs.

The preceding description is of a presently preferred embodiment of the invention wherein PCBs are removed from an operating transformer by extraction, separation and decomposition of the PCBs in separate unit processes. With a simple modification, this process may also be applied in a one-step procedure to transformers in storage, or to any PCB-contaminated functional fluid stored in drums. In this modification a composition comprising a mixture of the polyethylene glycol extraction agent and the NaPEG reagent is added with agitation to the functional fluid in a container, and the container is allowed to stand for an extended period of time, on the order of three months, with occasional venting to permit the introduction of air into the container. The polyethylene glycol selectively extracts PCBs from the functional fluid and the NaPEG reagent introduced with the polyethylene glycol reacts with the PCBs and oxygen from the air to dehalogenate the PCBs.

In order to form a stable dispersion of the composition in the fluid undergoing treatment the aforesaid composition should contain a suitable surfactant of the general formula, $H—O(—CH_2—CH_2—O)_x—R$, wherein x is $\geqq 2$ and R represents an alkyl group having 12 or more carbon atoms, an aralkyl group, an ester residue, or a polypropylene glycol group. Suitable surfactants of the above formula include Igepal®, Pluronic® or Triton®. If desired, these materials may be used in the production of the NaPEG reagent in accordance with the teachings of the aforementioned copending applications.

The amount of composition employed may vary depending on the PCBs content of the functional fluid being treated. Satisfactory results have been obtained using about 2 percent of a 1:1 PEG to NaPEG composition, based on the volume of fluid to be treated. The spent composition and dehalogenation reaction products are easily removed from the treated functional fluid, e.g. by washing with water.

The modified process just described provides a safe, efficient and effective way for reducing the PCB content of dielectric fluids of PCB Contaminated Transformers to below 50 ppm. The principal benefit of this modified process is that it obviates significant investment in chemical processing equipment.

The operation of the present invention will be further understood by reference to the following specific examples.

The concentrations of PCBs reported in the examples were determined by comparing the areas of selected peaks from the gas chromatographs of cyclohexane extracts of unknown concentration with those of a standard solution of PCBs (either Pyranol or Inerteen) in cyclohexane. So long as the peak areas on the chromatographs were on the same order of magnitude they were considered suitable for comparision.

In order to quantitatively calculate the PCB concentration of a particular unknown sample, three to five representative peaks were selected from the chromatograph of the unknown sample as a reference for comparision and the total area of each peak was determined and compared with the corresponding peaks on the chromatograph of the standard solution. Thus, for example, if the total area of the selected peaks for the unknown sample was measured to be 50% of the corresponding peaks for the standard, the concentration of PCBs in the unknown sample was determined to be 50% that of the standard. In making these calculations dilution effects were considered negligible inasmuch the volume of the extraction agent employed and the solution being extracted were equal. As previously noted, PCBs are substantially completely removed from polyethylene glycol by cyclohexane.

To evaluate the scientific acceptability of the data used in making these calculations three to six replications of the experiment were carried out for the selected peaks, and the peak area data were subjected to statistical analysis by the Chauvenet criterion and all data were found to be acceptable.

EXAMPLE 1

A sample of commercial transformer oil known to contain 600 ppm Pyranol (PCBs) was treated by adding equal volumes to the oil and polyethylene glycol (average M.W. 400) to a large beaker and stirring the mixture until equilibration was reached, generally a minimum of 3 minutes. The immiscible mixture was then transferred to a separatory funnel and the lower polyethylene glycol-PCB phase was drawn off and treated with an equal volume of cyclohexane was stirring for a minimum of 3 minutes. A second mixture was formed and was separated as before, except that the cyclohexane-PCB layer was the upper phase in the separatory funnel.

The cyclohexane-PCB solution thus obtained was then analyzed by a conventional gas chromatograph-electron capture (g.c.-e.c.) detector and compared with the chromatogram of a standard solution of known concentration of Pyranol in cyclohexane. This extract was found to contain 152 ppm of Pyranol. This represents approximately 25% of the PCBs in the original sample of the transformer oil, inasmuch as equal volumes were used in the extractions and cyclohexane effects substantially quantitative removal of PCBs from polyethylene glycol.

EXAMPLE 2

A solution of Pyranol in mineral oil was prepared containing approximately 1000 ppm of PCBs. A sample of this standard solution was extracted with polyethylene glycol (average M.W. 400) which, in turn was extracted with cyclohexane, as described in Example 1. The cyclohexane extract was analyzed by g.c.-e.c., as in Example 1, and it was determined that the recovery was 24.3% of the Pyranol present in the prepared solution. At this rate, (according to the equation set forth in Example 4, below) about 7 to 8 extractions would effect substantially complete removal of the Pyranol from the mineral oil.

EXAMPLE 3

A determination was made of the amount of Inerteen (a proprietary PCB), which can be recovered from an oil in a single extraction according to the present invention.

A small amount (0.1 g.) of Inerteen, was added to 100 ml. of Nujol mineral oil and agitated until a homogeneous solution was obtained. The concentration of Inerteen in the mineral oil was calculated to be 1162 ppm.

A 50 ml. sample of this solution was added to 50 ml. of polyethylene glycol (average M.W. 400) and the immiscible mixture was stirred vigorously at room temperature for about 3 minutes. Stirring was stopped and after separation of the layers 50 ml. of cyclohexane was added to the lower (PEG) phase. This second extraction was carried out for about 3 minutes and the upper (cyclohexane) phase was separated and analyzed by g.c.-e.c. as in Example 1 above.

When the chromatogram was compared to that of a standard Inerteen solution containing 1069 ppm, it was found that the percentage of recovery of the PCB on this single two-step extraction was 25.7%.

EXAMPLE 4

The purpose of this experiment was to determine the effect of water on the distribution of PCBs between a polyethylene glycol-water mixture and cyclohexane. This was intended to simulate a situation in which the PCB-contaminated liquid undergoing treatment contains water which would be transferred to the polyethyleneglycol during extraction.

A standard solution of 106.9 ppm Interteen in cyclohexane was prepared by quantitative dilution of a stronger standard solution. An aqueous polyethylene glycol solution (67% by volume water) was prepared and a 5 ml. sample thereof was interfaced with an equal volume of the just described standard cyclohexane-PCB solution. The mixture was vigorously agitated for about 3 minutes, after which the cyclohexane layer was injected into the g.c./e.c. detector. Because equal volumes of cyclohexane and extraction agent were used there were no dilution effects to be compensated for in the concentration calculations.

The precentage of PCB extracted (E) by the cyclohexane is calculated from the equation:

$$E = 100\left[1 - \frac{1}{(D_m + 1)^n}\right]$$

wherein $D_m$ is the mole distribution ratio which is defined by:

$$D_m = \frac{\text{concentration of PCB in cyclohexane}}{\text{concentration of PCB in water}}$$

and n represents the number of extractions which have been performed. For the derivation of this equation, see: Fritz and Schenk, *Quantitative Analytical Chemistry,* at 348–49 (4th ed.). It should be noted that $D_m$, as set forth above, relates to the extraction of PCBs from water into cyclohexane. Once $D_m$ has been obtained for any particular system, the number of extractions necessary to extract any given percentage of the PCB into the extractant can be determined.

In the present experiment it was found that approximately 10 to 12% of the PCB present in the system was retained by the water-PEG layer when an extraction with cyclohexane was performed. This corresponds to a $D_m$ value of approximately 8 for this system. Using this value in the above equation and solving for n, it was found that three extractions are required for essentially complete removal of the PCB from the water. It can thus be seen that additional extractions will be required to achieve complete extraction of PCBs from a system containing a substantial amount of water.

In this example, "essentially complete extraction" was deemed to have been achieved when the percentage of PCBs extracted exceeded 99.9%.

This example shows that even when the original PCB-contaminated liquid (or the PEG extractant agent) contains substantial amounts of water, the PCBs can be reduced to an acceptable level simply by increasing the total number of extractions. As previously noted, however, interference due to the presence of water in the system may often be avoided.

EXAMPLE 5

A test was conducted to determine the utility of solid Carbowax polyethylene glycol (average M.W. 20,000) in selectively extracting PCBs from an oil medium.

A sample of hydrocarbon oil (500 ml.) containing about 1472 ppm. of Inerteen was placed in a 150 ml. beaker and about 75 g. of Carbowax (average M.W. 20,000) was added at room temperature and slurried with the oil. Fractions were removed at timed intervals and analyzed for PCB content. The oil-polyethylene glycol mixture was stirred continually on a magnetic stirring apparatus at room temperature. The oil had a density of 0.91 g/ml. The PCB content of the oil dropped from an initial 1472 ppm to 957 ppm in 90 minutes. This amounts to an extraction of about 35% of the PCB content of the oil which compares favorably with the efficiency of lower molecular weight polyethylene glycols.

EXAMPLE 6

Another test along the lines of Example 5 was conducted by placing 200 ml. of Carbowax in a beaker containing 200 ml. of a transformer oil having a PCB concentration of about 200 ppm. The mixture was stirred continually and a sample was removed after 30 minutes and analyzed for PCB content by g.c.-e.c. as before. It was found that 41% of the PCB content of the oil had been extracted.

EXAMPLE 7

A series of tests was conducted to determine whether the polyethylene glycol extraction agent for PCBs would itself contaminate the treated oil. Samples were prepared of PCB-contaminated switch fluid not extracted with polyethylene glycol, the same fluid after extraction with PEG (average M.W. 400), and pure polyethylene glycol (average M.W. 400). The extraction was carried out by adding 50 ml. of polyethylene glycol to 50 ml. of the oil and agitating the mixtures vigorously for three minutes.

The presence or absence of polyethylene glycol was determined by the presence or absence of the characteristic —OH band at 3700–3200 $cm^{-1}$ of the infrared spectrum. No polyethylene glycol was detected in the extracted sample of oil, thus indicating that at the detection limits of infrared spectroscopy the extraction agent does not itself contaminate the oil.

EXAMPLE 8

A series of extractions of an oil containing Inerteen with and without added water was run to determine whether or not the presence of water mixed with a treated oil would adversely affect the extraction efficiency of polethylene glycol. Analyses of the resulting extracts showed that the extraction efficiency of polyethylene glycol is not appreciably affected by up to about 15% water by weight in the PEG phase.

Those skilled in the art will appreciate that the procedures disclosed in the foregoing examples are merely illustrative and are capable of variation and modification without departing from the spirit and scope of the invention as defined in the appended claims.

What is claimed is:

1. A process for the removal of polychlorinated biphenyls from a fluid containing the same which comprises:

contacting said fluid with polyethylene glycol for a period of time sufficient for said glycol to selectively extract at least a portion of the chlorinated biphenyl compounds from said fluid; and separating the polyethylene glycol and extracted polychlorinated biphenyls from said fluid.

2. The process of claim 1 wherein the fluid is a dielectric fluid.

3. The process of claim 1 wherein the fluid comprises a hydrocarbon oil.

4. The process of claim 1 wherein the fluid is a transformer oil.

5. The process of claim 1 wherein the polyethylene glycol has an average molecular weight of from about 400 to about 20,000.

6. The process of claim 1 wherein the polyethylene glycol is a liquid.

7. The process of claim 1 wherein the polyethylene glycol is a solid.

8. The process of claim 6 wherein the process is repeated a sufficient number of times to reduce the polychlorinated biphenyl content of the fluid to a maximum of 50 ppm.

9. The process of claim 8 wherein the volume of the polyethylene glycol employed in each repetition is about the same as the volume of the fluid treated.

10. The process of claim 6 comprising the additional step of solvent extracting the polychlorinated biphenyl from the separated polyethylene glycol with a non-polar solvent and separating the resulting non-polar solvent polychlorinated biphenyl extract from said polyethylene glycol.

11. The process of claim 10 comprising the additional step of removing the cyclohexane from said non-polar solvent-polychlorinated biphenyl extract and dehalogenating the remaining polychlorinated biphenyl.

12. The process of claim 11 wherein dehalogenation is effected by treating said polychlorinated biphenyl with a reagent formed by the reaction of an alkali metal or an alkali metal hydroxide, with polyethylene glycol and oxygen.

13. The process of claim 7 comprising the additional step of solvent extracting the polychlorinated biphenyl compound from the separated polyethlene glycol with a non-polar solvent and separating the resulting non-polar solvent-polychlorinated biphenyl extract from said polyethylene glycol.

14. The process of claim 13 comprising the additional step of removing the cyclohexane from said non-polar solvent-polychlorinated biphenyl extract and dehalogenating the remaining polychlorinated biphenyl.

15. The process of claim 14 wherein dehalogenation is effected by treating said polychlorinated biphenyl with a reagent produced by the reaction of an alkali metal or an alkali metal hydroxide, with polyethylene glycol and oxygen.

16. A process for the removal of polychlorinated biphenyl from the dielectric fluid of an electrical transformer which comprises:

drawing off dielectric fluid from said transformer;

contacting said drawn off fluid with polyethylene glycol for a period of time sufficient for said glycol to selectively extract at least a portion of the polychlorinated biphenyl from said fluid;

separating from said fluid the polyethylene glycol containing extracted polychlorinated biphenyl; and returning said fluid to said transformer.

17. The process of claim 16 wherein the transformer is an operating transformer.

18. A process for removing and detoxifying a polychlorinated biphenyl present in the dielectric fluid of an electrical transformer which comprises:

drawing off dielectric fluid from said transformer;

contacting said drawn off fluid with polyethylene glycol in a primary extraction operation for a period of time sufficient for said glycol to selectively extract at least a portion of the chlorinated biphenyl from said fluid; separating from said fluid the polyethylene glycol containing extracted polychlorinated biphenyl;

returning said fluid to said transformer;

solvent extracting with cyclohexane the chlorinated biphenyl compound from the polyethylene glycol in a secondary extraction operation to form a cyclohexane-polychlorinated biphenyl extract;

separating said cyclohexane-polychlorinated biphenyl extract from said polyethylene glycol and recycling the latter to said primary extraction operation;

removing cyclohexane from said cyclohexane-polychlorinated biphenyl extract and dehalogenating the remaining polychlorinated biphenyl; and recycling said cyclohexane to said secondary extraction operation.

19. The process of claim 18 wherein dehalogenation is effected by treating said polychlorinated biphenyl with a reagent produced by the reaction of sodium, or sodium hydroxide, with polyethylene glycol and oxygen.

20. A process for removing and detoxifying polychlorinated biphenyls present in a fluid containing the same which comprises contacting the fluid with a treating composition comprising polyethylene glycol and a dehalogenation reagent produced by the reaction of an akali metal or alkali metal hydroxide, with polyethylene glycol and oxygen, and extracting the polychlorinated biphenyls in the fluid into said composition;

introducing oxygen into said composition containing said polychlorinated biphenyls, thereby to effect dehalogenation of the polychlorinated biphenyls by the dehalogenated reagent; and separating any remaining treating composition and components thereof and, dehalogenation reaction products from said fluid.

21. The process of claim 20 wherein said treating composition includes a surfactant of the general formula, $H—O(—CH_2—CH_2—O)—R$, wherein x is $\geqq 2$ and R represents an alkyl group having 12 or more carbon atoms, an aralkyl group, an ester residue or a polypropylene glycol group.

22. The process of claim 20 wherein the fluid is a dielectric fluid.

23. The process of claim 20 wherein the fluid comprise a hydrocarbon oil.

24. The process of claim 20 wherein the fluid is a transformer oil.

25. The process of claim 20 wherein the polyethylene glycol has an average molecular weight of from about 400 to about 20,000.

26. The process of claim 25 wherein the process is repeated a sufficient number of times to reduce the polychlorinated biphenyl content of the fluid to a maximum of 50 ppm.

27. The process of claim 10, wherein the non-polar solvent is cyclohexane.

28. The process of claim 11, wherein the non-polar solvent is cyclohexane.

29. The process of claim 13, wherein the non-polar solvent is cyclohexane.

30. The process of claim 14, wherein the non-polar solvent is cyclohexane.

31. The process of claim 12, wherein the alkali metal is sodium and the alkali metal hydroxide is sodium hydroxide.

32. The process of claim 15, wherein the alkali metal is sodium and the alkali metal hydroxide is sodium hydroxide.

33. The process of claim 20, wherein the alkali metal is sodium and the alkali metal hydroxide is sodium hydroxide.

* * * * *

UNITED STATES PATENT AND TRADEMARK OFFICE

CERTIFICATE OF CORRECTION

PATENT NO. : 4,430,208

DATED : February 7, 1984

INVENTOR(S) : Louis L. Pytlewski and Edward J. Thorne

It is certified that error appears in the above-identified patent and that said Letters Patent is hereby corrected as shown below:

Column 1, line 57, "reslt" should be --result--.

Column 4, line 35, "depening" should be --depending--.

Column 5, line 21, "of" should be --to--.

Signed and Sealed this

*Twenty-third* Day of *October 1984*

[SEAL]

*Attest:*

GERALD J. MOSSINGHOFF

*Attesting Officer*

*Commissioner of Patents and Trademarks*